US005469705A

United States Patent [19]

Glenn, Jr.

[11] Patent Number: 5,469,705

[45] Date of Patent: Nov. 28, 1995

[54] HEAT RECOVERY IN A LIQUID RING PUMP SEAL LIQUID CHILLER SYSTEM

[75] Inventor: John K. Glenn, Jr., Huntington, Conn.

[73] Assignee: The Nash Engineering Company, Trumbull, Conn.

[21] Appl. No.: 293,835

[22] Filed: Aug. 22, 1994

[51] Int. Cl.[6] ..... F28B 7/00

[52] U.S. Cl. ..... 60/693; 60/656

[58] Field of Search ..... 60/692, 693, 694, 60/646, 656, 657

[56] References Cited

U.S. PATENT DOCUMENTS

| | | | |
|---|---|---|---|
| 4,359,313 | 11/1982 | Bernard | 417/68 |
| 4,558,228 | 12/1985 | Larjola | 60/646 |
| 4,658,589 | 4/1987 | Sutrina | 60/657 |

*Primary Examiner*—Ira S. Lazarus
*Assistant Examiner*—Alfred Basichas
*Attorney, Agent, or Firm*—Fish & Neave; Robert R. Jackson

[57] ABSTRACT

In a power plant having a boiler for heating a fluid to form a gaseous phase, a power generator for generating electrical power from the gaseous phase, a condenser for condensing the gaseous phase after the gaseous phase has passed through the power generator, a liquid ring pump for evacuating uncondensed gaseous phase from the condenser, and a chiller for cooling seal liquid discharged from the liquid ring pump for re-use in the liquid ring pump, apparatus is provided for utilizing the heat generated during the operation of the chiller to heat a predetermined portion of the fluid supplied to the boiler, thereby reducing the amount of heat which must be provided by the boiler to form a gaseous phase of the fluid so that electricity can be generated. The efficiency of the power plant is thereby increased.

8 Claims, 1 Drawing Sheet

17
9
13b
8
16
10
RECEIVER
3
13a
15
LIQUID
RING PUMP
19
13
BOILER
20
18
25b
CHILLER
25a
30
35
25
TURBINE
42
GENERATOR
40
60
22
45
CONDENSER
51
52
50

HEAT RECOVERY IN A LIQUID RING PUMP SEAL LIQUID CHILLER SYSTEM

BACKGROUND OF THE INVENTION

The present invention relates to methods and apparatus for increasing the efficiency of a power plant. More particularly, in a power plant having a boiler for heating a fluid (typically water) to form a gaseous phase (typically steam), a power generator for generating electrical power from the gaseous phase, a condenser for partly condensing the gaseous phase to a liquid phase (typically water again) after the gaseous phase has passed through the power generator, a liquid ring vacuum pump for evacuating uncondensed gaseous phase from the condenser, and a chiller for cooling seal liquid (typically water) discharged from the liquid ring pump for re-use in the liquid ring pump, the present invention provides apparatus for utilizing the heat generated during the operation of the chiller to heat a portion of the fluid supplied to the boiler, thereby reducing the amount of heat which must be provided by the boiler in order to form a gaseous phase of the fluid so that electricity can be generated. The heat recovered from the chiller includes the heat generated by (1) vapor condensation in the vacuum pump, (2) gas compression in the vacuum pump, and (3) chiller compression work.

In order to lower the pressure in the condenser of a turbine-driven power plant, previous power plants have used a liquid ring pump to partly evacuate uncondensed steam and leakage air from the condenser. Seal liquid which is discharged from the liquid ring pump is typically cooled and then re-used in the liquid ring pump. Providing the liquid ring pump with cool seal liquid increases the efficiency of the liquid ring pump. As described in U.S. Pat. No. 4,359,313 (which is hereby incorporated by reference herein), the discharged seal liquid can be cooled using a chiller (e.g., a mechanical cooler of the refrigerant evaporative type), the use of which further increases the efficiency of the liquid ring pump because the discharged seal liquid can be cooled to a lower temperature than is possible with a passive system such as one that uses cooling water to absorb heat from the discharged seal liquid. In cooling the seal liquid, the chiller produces heat which, in previous systems, has been carried away by cooling water or dissipated to the air surrounding the chiller.

In order to maximize the efficiency of the power plant, it would be desirable to use the heat generated by the chiller to heat a portion of the fluid delivered to the boiler, thereby reducing the amount of energy which must be provided by the boiler to convert the fluid to a gaseous phase so that electricity may be generated.

SUMMARY OF THE INVENTION

It is therefore an object of the present invention to utilize the heat generated by the chiller to heat a portion of the fluid used by the boiler, thereby reducing the amount of additional energy required to convert the fluid into a gaseous phase by the boiler and increasing the efficiency of the power plant. To accomplish this, the present invention provides a conduit for conveying a predetermined portion of the liquid condensed in the condenser of a power plant to the chiller so that it can be heated by heat generated during the operation of the chiller. The heated liquid is then conveyed to the boiler to be further heated so that electrical power can be generated. The present invention thus increases the efficiency of a power plant by making use of heat which, in previous power plants, is discarded.

The above and other objects of the invention will be apparent upon consideration of the following detailed description taken in conjunction with the accompanying drawing.

DETAILED DESCRIPTION OF THE PREFERRED EMBODIMENTS

Figure 1:
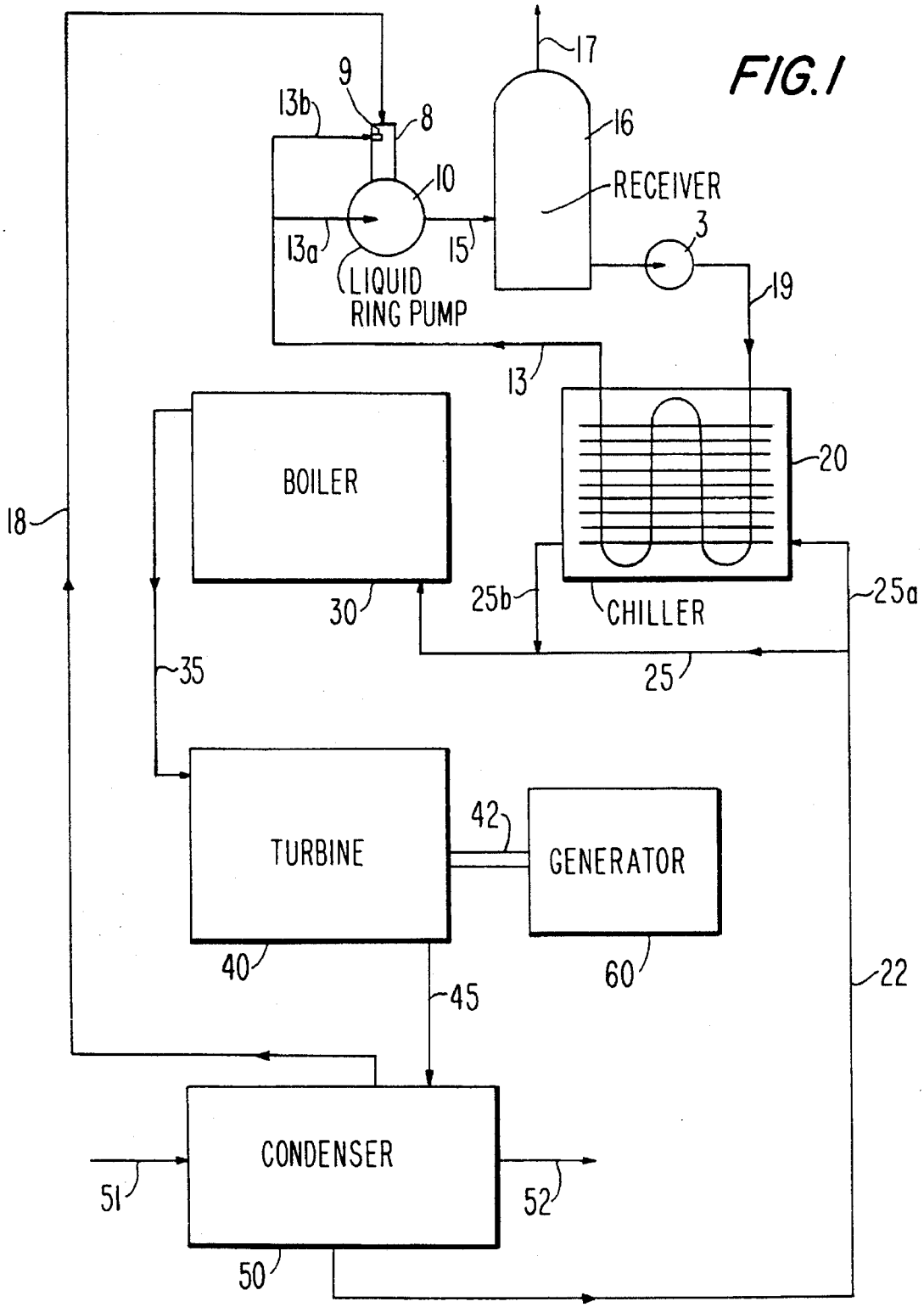
FIG. 1 is a simplified schematic drawing of a power plant constructed in accordance with the present invention.

In the preferred embodiments, the present invention provides a power plant having a boiler for heating water in order to form steam which is used to power a turbine. Electrical power is generated in a generator which is mechanically coupled to the turbine. After passing through the turbine, the steam is partly condensed to water in a condenser so that it may be returned to the boiler for re-use in the power generating cycle. A liquid ring vacuum pump is provided to evacuate uncondensed steam (and air which may have leaked into the system) from the condenser. Seal liquid (typically water) discharged from the liquid ring pump is cooled by a chiller and then returned to the liquid ring pump for re-use in the pump. In accordance with the present invention, a predetermined portion of the water collected in the condenser is conveyed to the chiller wherein it absorbs heat produced during the operation of the chiller. The heated water is then conveyed to the boiler for further heating to produce steam. By using the heat generated by the chiller to heat a portion of the condensed water before returning it to the boiler, the efficiency of the power plant is increased.

A schematic diagram of an illustrative power plant constructed in accordance with the present invention is shown in FIG. 1. Fluid (preferably water) is heated by boiler 30 in order to form a gaseous phase (preferably steam) of the fluid. The gaseous phase passes through conduit 35 to an electric power generator comprising turbine 40 and generator 60 which is attached to turbine 40 by mechanical coupler 42. After passing through turbine 40, the gaseous phase is conveyed to condenser 50 via conduit 45. In condenser 50 the gaseous phase is partly condensed to a liquid phase by cooling water which passes into condenser 50 through conduit 51 and is carried away from condenser 50 through conduit 52.

Liquid ring pump 10 having a seal liquid (preferably water) is provided in order to evacuate uncondensed gas from condenser 50 at a predetermined rate. To this end, inlet 8 of liquid ring pump 10 is connected to condenser 50 via conduit 18. The main component of the gas present in condenser 50 is uncondensed gaseous phase produced by boiler 30, but the gas may also include air which has leaked into the system. It is desirable to remove this air because it may interfere with the condensation process in the condenser and may also promote the corrosion of boiler components. Furthermore, the evacuation of gas from condenser 50 increases the efficiency of the condenser by producing a lower pressure therein, which increases the power output by turbine 40.

Seal liquid (which has absorbed the heats of vapor condensation and gas compression in liquid ring pump 10) is discharged from liquid ring pump 10 during the pumping process. The discharged seal liquid passes through conduit 15 and collects in receiver 16. Vent 17 of receiver 16 allows gas to escape to the atmosphere while seal liquid collects in a reservoir (not shown) of receiver 16. The seal liquid collected in receiver 16 is pumped by pump 3 through conduit 19 to chiller 20 which cools the seal liquid. Chiller 20 may be any of several conventional types of chillers. For example, chiller 20 may be a conventional mechanical shell-and-tube cooler of the refrigerant evaporative type. (U.S. Pat. No. 4,359,313 contains a detailed description of the use of a chiller to cool the seal liquid of a liquid ring pump.) The cooled seal liquid is then returned to liquid ring pump 10 via conduit 13*a* for re-use in liquid ring pump 10. By providing cool seal liquid to liquid ring pump 10, the efficiency thereof is increased.

Inlet 8 of liquid ring pump 10 includes nozzle 9 which is connected to conduit 13*b*. Cooled seal liquid from conduit 13*b* is sprayed by nozzle 9 into inlet 8, thereby partly condensing uncondensed gaseous phase (steam in the preferred embodiment) flowing into liquid ring pump 10. The liquid spray thus increases the rate of evacuation of gas from condenser 50. Further condensation of uncondensed gaseous phase occurs in liquid ring pump 10 wherein uncondensed gaseous phase partly condenses on the surface of, and then becomes mixed with, the seal liquid of pump 10.

During the process of cooling the seal liquid, heat is generated by chiller 20. This heat includes (1) heat removed from the seal liquid and (2) heat generated by the components of the chiller in performing work in order to remove heat from the seal liquid (e.g., heat generated by refrigerant gas compression in the chiller). The heat removed from the seal liquid includes the heat generated by vapor condensation and gas compression in the liquid ring pump.

In accordance with the present invention, the heat produced by chiller 20 is used to heat a predetermined portion of the liquid which is conveyed from condenser 50 to boiler 30, thereby reducing the amount of heat which must be supplied by boiler 30 to convert the liquid to gaseous phase. To accomplish this, liquid is conveyed via conduit 22 from condenser 50 to conduits 25 and 25*a*. Conduit 25*a* conveys a predetermined portion of the liquid to chiller 20 so that the predetermined portion of liquid is heated by the heat removed or produced during the operation of chiller 20. The heated liquid then passes through conduit 25*b* and is recombined with the liquid in conduit 25. The combined liquid is then conveyed to boiler 30 and further heated therein to produce a gaseous phase for use in turbine 40. The efficiency of the power plant is thus increased by utilizing the heat generated by the chiller in order to produce a gaseous phase of the fluid rather than allowing the heat to dissipate into the surroundings.

Thus, having shown apparatus for using the heat generated by the chiller to heat a portion of the liquid conveyed to the boiler of a power plant, it will be understood that the foregoing is only illustrative of the principles of the present invention and that various modifications can be made by those skilled in the art without departing from the spirit or scope of the invention. For example, in order to replenish the supply of fluid in boiler 30, a conduit can be provided for allowing fresh fluid (i.e., makeup water in the preferred embodiment) to enter conduit 25*a* and to be heated by chiller 20 before being conveyed to boiler 30. It will further be clear to those skilled in the art that boiler 30 can generate heat by combustion of a suitable fuel (e.g., coal or petroleum) or by a controlled thermonuclear reaction.

What is claimed is:

1. A power plant comprising:

a boiler for heating a fluid in order to form a gaseous phase of said fluid;

a power generator for generating electrical power from said gaseous phase, said power generator having a first conduit for conveying said gaseous phase from said boiler to said power generator;

a condenser for partly condensing said gaseous phase to a liquid phase of said fluid after said gaseous phase has passed through said power generator, said condenser having a second conduit for conveying said gaseous phase from said power generator to said condenser;

a liquid ring pump for evacuating uncondensed gaseous phase from said condenser at a predetermined rate through a third conduit connected between said liquid ring pump and said condenser;

a chiller for cooling seal liquid discharged from said liquid ring pump, said chiller having a fourth conduit for conveying said seal liquid discharged from said liquid ring pump to said chiller, and a fifth conduit for conveying said seal liquid from said chiller to said liquid ring pump for re-use in said liquid ring pump after said seal liquid has been cooled by said chiller;

a sixth conduit for conveying a predetermined portion of said liquid phase from said condenser to said chiller so that said predetermined portion of said liquid phase is heated by heat generated during the operation of said chiller; and a seventh conduit for conveying said predetermined portion of said liquid phase from said chiller to said boiler after said predetermined portion of said liquid phase has been heated by said chiller, said predetermined portion of said liquid phase being re-used in said boiler by being further heated in order to generate electrical power.

2. The apparatus defined in claim 1 wherein said electrical power generator comprises a turbine.

3. The apparatus defined in claim 1 wherein said chiller comprises a mechanical cooler.

4. The apparatus defined in claim 1 wherein said heat generated during the operation of said chiller includes heat removed from said seal liquid by said chiller.

5. The apparatus defined in claim 1 wherein said heat generated during the operation of said chiller includes heat generated by the work done by said chiller in removing heat from said seal liquid.

6. The apparatus defined in claim 1 wherein said seal liquid is substantially water.

7. The apparatus defined in claim 1 wherein said fluid is substantially water.

8. In a power plant having a boiler for heating a fluid in order to form a gaseous phase of said fluid, a power generator for generating electrical power from said gaseous phase, a condenser for partly condensing said gaseous phase to a liquid phase after said gaseous phase has passed through said power generator, a liquid ring pump having a seal liquid for evacuating uncondensed gaseous phase from said condenser, and a chiller for cooling seal liquid discharged from said liquid ring pump for re-use in said liquid ring pump, a method of utilizing the heat generated during the operation of the chiller comprising the steps of:

conveying a predetermined portion of said liquid phase which is condensed in said condenser from said condenser to said chiller;

heating said predetermined portion of said liquid phase by the heat generated during the operation of the chiller; and conveying said predetermined portion of said liquid phase from said chiller to said boiler, said predetermined portion of said liquid phase being re-used in said boiler by being further heated by said boiler in order to generate electrical power.

* * * * *